US008763317B2

(12) United States Patent
Krell

(10) Patent No.: US 8,763,317 B2
(45) Date of Patent: Jul. 1, 2014

(54) CONCRETE ROOF PANEL

(75) Inventor: Clinton C. Krell, Waukesha, WI (US)

(73) Assignee: The Spancrete Group, Inc., Waukesha, WI (US)

( * ) Notice: Subject to any disclaimer, the term of this patent is extended or adjusted under 35 U.S.C. 154(b) by 677 days.

(21) Appl. No.: 12/319,027

(22) Filed: Dec. 31, 2008

(65) Prior Publication Data

US 2010/0162651 A1 Jul. 1, 2010

(51) Int. Cl.
*E04B 7/02* (2006.01)
*E04B 7/04* (2006.01)

(52) U.S. Cl.
USPC ..... 52/91.1; 52/93.1

(58) Field of Classification Search
USPC ..... 52/91.1, 91.3, 93.1, 602, 604, 301.9, 52/319, 223.6, 223.7
See application file for complete search history.

(56) References Cited

U.S. PATENT DOCUMENTS

| | | | | |
|---|---|---|---|---|
| 814,134 | A | | 3/1906 | Hood |
| 1,205,465 | A | | 11/1916 | Maguire et al. |
| 1,821,355 | A | * | 9/1931 | Murray ..... 52/336 |
| 2,053,873 | A | * | 9/1936 | Niederhofer ..... 52/213 |
| 2,139,623 | A | | 12/1938 | Marston |
| 2,337,743 | A | * | 12/1943 | Deuel ..... 52/94 |
| 2,592,634 | A | | 4/1952 | Wilson |
| 2,691,291 | A | | 10/1954 | Henderson |
| 3,252,682 | A | * | 5/1966 | Soukup ..... 249/158 |
| 3,319,387 | A | | 5/1967 | Stewing et al. |
| 3,495,371 | A | | 2/1970 | Mitchell, Jr. |
| 3,510,997 | A | | 5/1970 | Ratych |
| 3,621,624 | A | | 11/1971 | Gustafson |
| 3,693,308 | A | | 9/1972 | Trezzini et al. |
| 3,724,141 | A | | 4/1973 | Kelleher |
| 3,772,835 | A | | 11/1973 | Cox et al. |
| 3,898,776 | A | * | 8/1975 | Cox et al. ..... 52/79.14 |
| 3,918,222 | A | | 11/1975 | Bahramian |
| 3,952,471 | A | | 4/1976 | Mooney |
| 4,001,990 | A | | 1/1977 | Chase et al. |
| 4,100,705 | A | | 7/1978 | Diana |
| 4,231,199 | A | * | 11/1980 | Gomez et al. ..... 52/91.2 |
| 4,240,233 | A | | 12/1980 | Vercelletto |
| 4,398,378 | A | | 8/1983 | Heitzman |
| 4,513,545 | A | | 4/1985 | Hopkins, Jr. |
| 4,545,159 | A | | 10/1985 | Rizk |
| 4,569,167 | A | | 2/1986 | Staples |

(Continued)

FOREIGN PATENT DOCUMENTS

WO WO91/02855 3/1991

OTHER PUBLICATIONS

Office Action dated Apr. 15, 2011 in Related U.S. Appl. No. 12/317,983, filed Dec. 31, 2008.

(Continued)

*Primary Examiner* — Basil Katcheves
*Assistant Examiner* — Theodore Adamos
(74) *Attorney, Agent, or Firm* — Ryan Kromholz & Manion, S.C.

(57) ABSTRACT

A concrete roof panel for constructing a peaked concrete roof on a building has a first planar member coupled to a second planar member at an angle other than 180 degrees. The roof panel includes at least one rib member coupled to the inside surface of the roof panel. The roof panel includes a flattened attachment portion at either end thereof for connecting the roof panel to a side wall of a building.

11 Claims, 6 Drawing Sheets

(56) References Cited

U.S. PATENT DOCUMENTS

| | | | | |
|---|---|---|---|---|
| 4,598,515 | A | 7/1986 | Diana | |
| 4,627,205 | A | 12/1986 | Hitchins | |
| 4,655,016 | A | 4/1987 | Jacob | |
| 4,759,160 | A | 7/1988 | Fischer | |
| 4,768,938 | A | 9/1988 | Greeson | |
| 4,909,001 | A | 3/1990 | Gonzalez Espinosa de Los Monteros | |
| 5,081,805 | A | 1/1992 | Jazzar | |
| 5,313,753 | A | 5/1994 | Sanger | |
| 5,381,635 | A | 1/1995 | Sanger | |
| 5,487,241 | A * | 1/1996 | Gorrell et al. | 52/79.1 |
| 5,671,582 | A | 9/1997 | Reay | |
| 5,678,372 | A | 10/1997 | Thomson et al. | |
| 5,761,862 | A | 6/1998 | Hendershot et al. | |
| 5,794,386 | A | 8/1998 | Klein | |
| 5,845,441 | A * | 12/1998 | Swartz | 52/250 |
| 5,865,001 | A | 2/1999 | Martin et al. | |
| 5,987,827 | A | 11/1999 | Lord | |
| 6,058,672 | A | 5/2000 | McClellan | |
| 6,073,401 | A | 6/2000 | Iri et al. | |
| 6,119,417 | A * | 9/2000 | Valverde et al. | 52/223.7 |
| 6,260,320 | B1 | 7/2001 | DiLorenzo | |
| 6,643,981 | B2 | 11/2003 | Pina et al. | |
| 6,668,507 | B2 | 12/2003 | Blanchet | |
| 6,698,150 | B1 | 3/2004 | DiLorenzo | |
| 6,955,016 | B1 | 10/2005 | Churches et al. | |
| 6,976,344 | B2 | 12/2005 | Sanger | |
| 7,007,431 | B2 | 3/2006 | Schubert | |
| 7,121,061 | B2 | 10/2006 | Jazzar | |
| 7,147,197 | B2 | 12/2006 | Dalton | |
| 2002/0069602 | A1 | 6/2002 | Blanchet | |
| 2007/0028531 | A1 | 2/2007 | Woodcock | |
| 2008/0060293 | A1 | 3/2008 | Hanlon | |
| 2008/0066395 | A1 | 3/2008 | Aranda et al. | |

OTHER PUBLICATIONS

Office Action dated Oct. 24, 2011 regarding U.S. Appl. No. 12/317,982, 10 pages.

Office Action dated Apr. 15, 2011 regarding U.S. Appl. No. 12/317,983, 16 pages.

Notice of Allowance dated Nov. 4, 2011 regarding U.S. Appl. No. 12/317,983, 11 pages.

* cited by examiner

CONCRETE ROOF PANEL

BACKGROUND OF THE INVENTION

The invention relates to building construction, and more particularly to precast roof panels for buildings. Prefabricated concrete panels have also been used to provide a modular building. However, many modular homes made of concrete panels utilize either flat concrete roofs or non-concrete roofs. It may be desirable to provide a concrete roof panel which is peaked.

SUMMARY OF THE INVENTION

The invention provides devices and methods for providing concrete roof panels for a building.

In one aspect of the invention, the roof panel includes a first member having an outer surface, an inner surface, a medial surface, a end surface, a first side surface, and a second side surface. The first member may have a first attachment portion formed on the inner surface near the side surface. The roof panel also includes a second member having an outer surface, an inner surface, a medial surface, an end surface, a first side surface, and a second side surface. The second member may have a second attachment portion formed on the inner surface near the end surface. The medial surface of the first member being coupled to the medial surface of the second member. The first member is not coplanar with the second member.

The roof panel may include a first rib member formed on the inner surface of the first member and a second rib member formed on the inner surface of the second member, each of the rib members extending along the inner surface from the medial surface to the attachment portion.

The roof panel may include a third rib member formed on the inner surface of the first member and a forth rib member formed on the inner surface of the second member, each of the rib members extending along the inner surface from the medial surface to the attachment portion Each rib member may include at least one stiffening member within the rib member.

The stiffening member may comprise rebar.

The roof panel may include at least one stiffening member included within each of the first member and the second member.

The stiffening member may comprise rebar.

The stiffening member may comprise wire mesh.

The roof panel may include an obtuse angle formed between inner surface of the first member and the inner surface of the second member.

The roof panel may include the medial surface of the first member being integrally formed to the medial surface of the second member.

The roof panel may include the first rib being integrally formed to the second rib.

The roof panel may include a stem portion formed on the inner surface of both the first member and the second member, the stem portion having a generally triangular configuration.

The roof panel may include at least one stiffening member included within the stem portion.

The stiffening member may comprise rebar.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
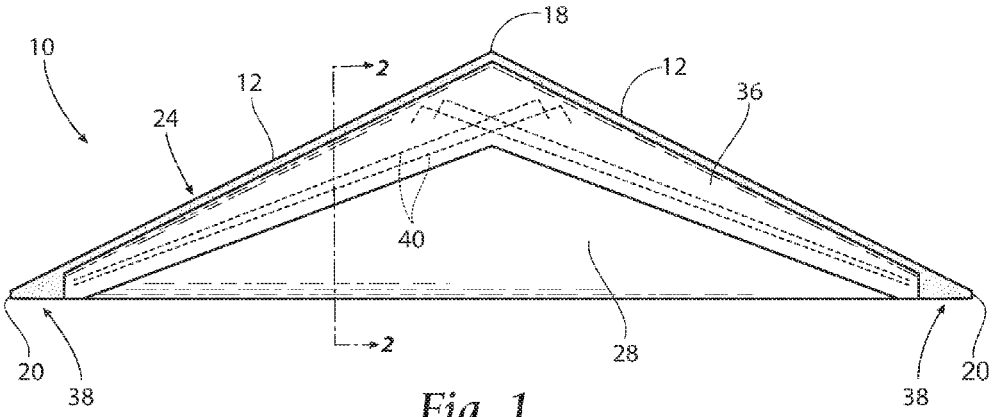
FIG. 1 is a side plan view of an embodiment of a roof panel according to the present invention.

FIGS. 1 through 6 shows concrete roof panels 10 for use on a building. The concrete panels 10 may be precast or may be sitecast. Preferably, the roof panels 10 are not pre-stressed concrete panels. Each roof panel 10 preferably includes a pair of generally planar roof members 12. Each roof member 12 is generally rectangular and has an outer surface 14, an inner surface 16, a medial surface 18, an end surface 22, and a pair of opposed side surfaces 22. Preferably, a pair of roof members 12 are integrally formed at their medial surfaces 18 to form a peak as shown in FIG. 1.

Figure 7:
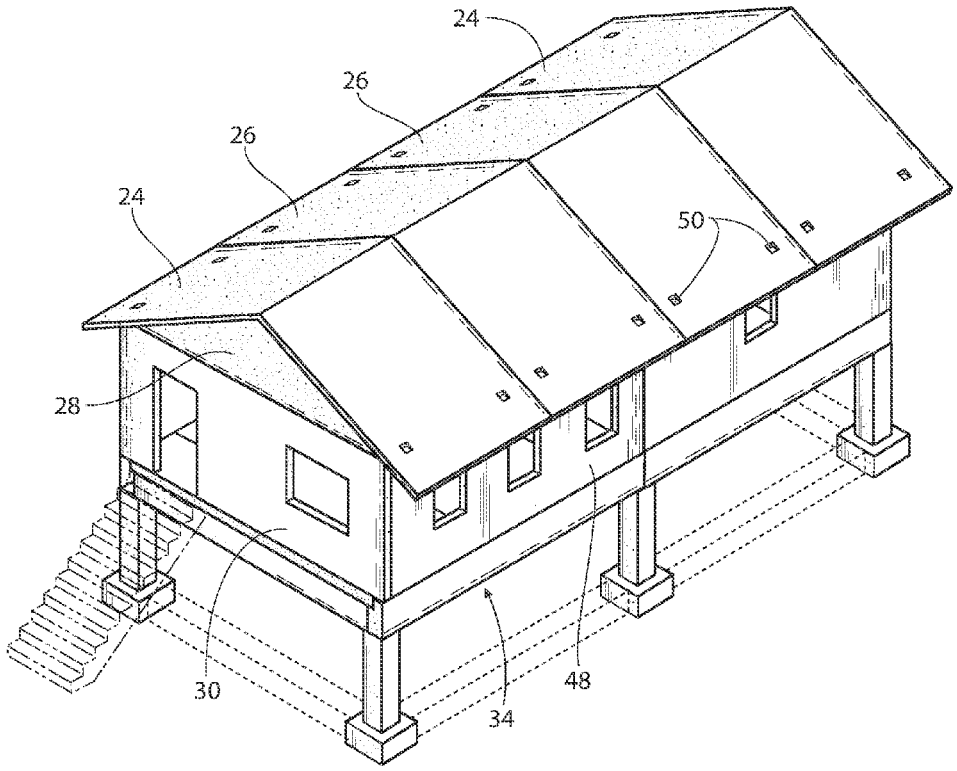
FIG. 7 is a perspective view showing the roof panels of FIGS. 1 and 4 in use on a building.

As shown in FIG. 7, it is contemplated that two types of roof panels 10 may be utilized on a building, end panels 24 and inner panels 26. An end roof panel 24 (FIGS. 1 through 3) preferably includes a stem portion 28 which is generally triangular in cross section and comprises a portion of the end walls 30 of the building 34 on which the roof panels 10 are being utilized. It is contemplated that a pair end roof panels 26 may be placed on the building 34; the stem portion 28 of the first end roof panel 24 being aligned with the front wall 30 of the building 34 and the stem portion 28 of the second end roof panel 24 being aligned with the rear wall 30 of the building 34.

Figure 2:
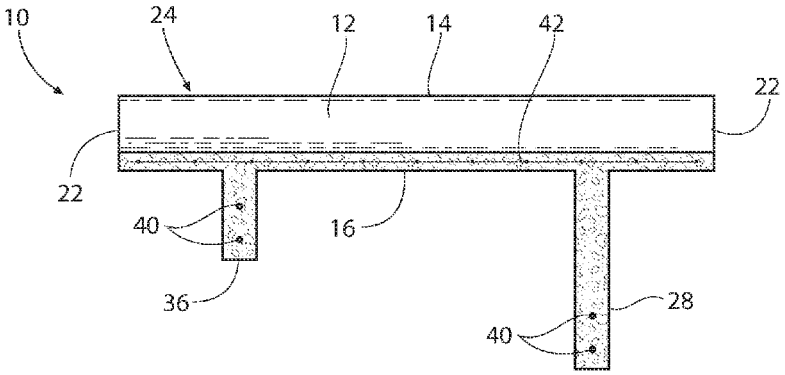
FIG. 2 is a cross sectional view taken along line 2-2 of FIG. 1.
Figure 3:
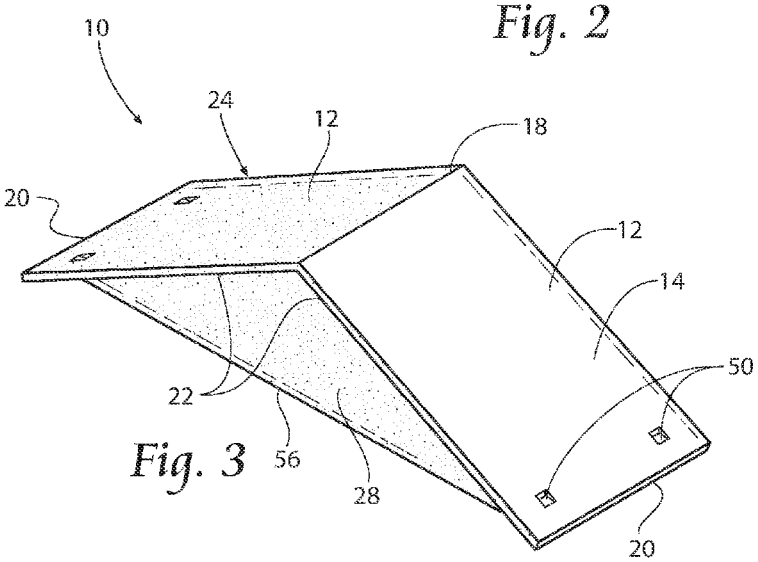
FIG. 3 is a perspective of the roof panel of FIG. 1.
Figure 5:
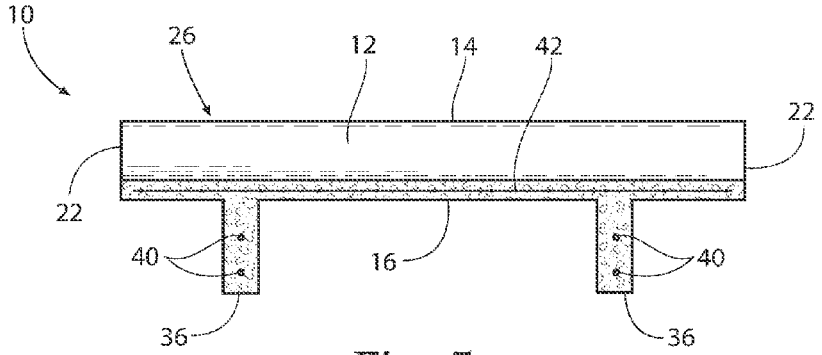
FIG. 5 is a cross sectional view taken along line 5-5 of FIG. 4.
Figure 6:
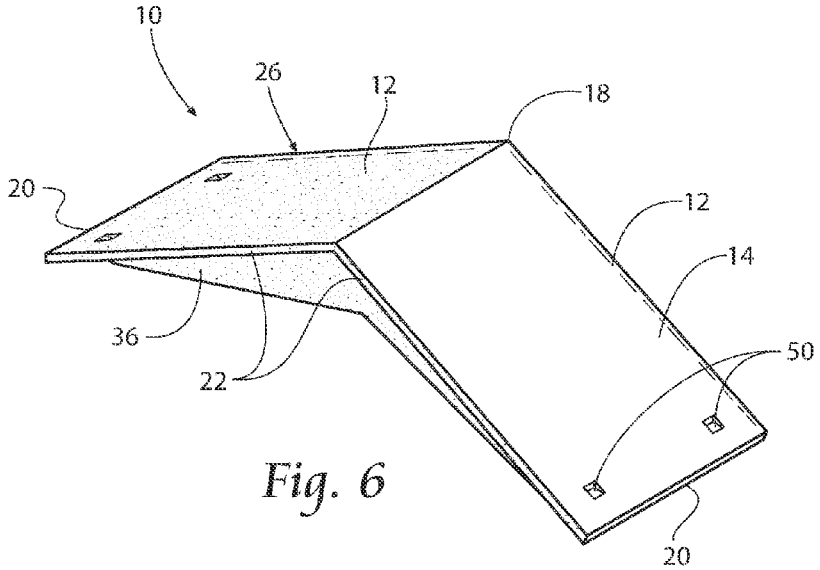
FIG. 6 is a perspective of the roof panel of FIG. 4.

Each roof member 12 preferably includes at least one as rib 36 shown in FIGS. 2 and 5. Preferably, each rib 36 extends along the inner surface 16 of each roof member 12 from the medial surface 18 to an attachment portion 38 formed near the end surface 20. Each rib 36 preferably includes at least one stiffening member 40. In the illustrated embodiment each rib 36 includes two stiffening members 40. The stiffening members 40 may take the form of rebar or any other type known in the art. It is further contemplated that each stem portion 28 may include at least one stiffening member 40. The stiffening members may take the form of rebar or any other type known in the art. Preferably, each roof member 12 includes at least one stiffening member 42. In the illustrated embodiment the stiffening member 42 takes the form of mesh as is known in the art. However, the stiffening member 42 may take any form known in the art.

It is contemplated that each end roof panel 24 may include one rib 36 on each roof member 12 (see FIG. 2) while each inner roof panel 26 may include a pair of ribs 36 on each roof member (see FIG. 5). However, it should be understood that any number of ribs 36 may be utilized.

Figure 4:
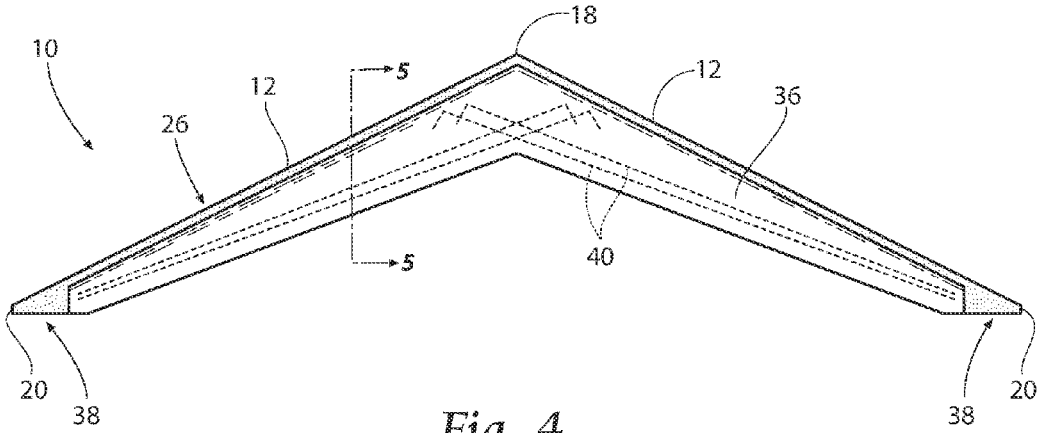
FIG. 4 is a side plan view of an alternative embodiment of a roof panel according to the present invention.

As seen in FIGS. 1 and 4 it is further contemplated that an attachment portion 38 may be formed on the inside surface 16 of each roof member 12. As shown in FIGS. 1 and 4, the attachment portion 38 is preferably located near the end surface 20 of each roof member 12. The attachment portion 38 preferably includes a flattened portion 44 which is sized and configured to mate with the top surface 46 of a side wall 48 of a building.

Figure 8:
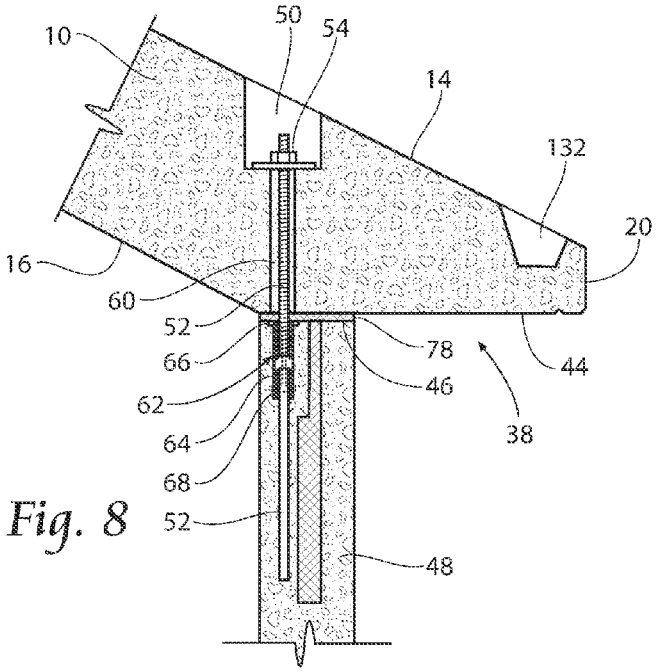
FIG. 8 is a cross sectional view of an embodiment of a joint between a roof panel of FIG. 1 and/or FIG. 4 and a side wall of a building.

As seen in FIGS. 7 and 8, roof panels 10 may further include a cavity 50 formed in the outer surface thereof. The cavity 50 is preferably sized and configured to accommodate a fixation member 52 such as a threaded rod and a locking member 54 such as a locking nut.

In use, a plurality of roof panels 10 are placed on top of a plurality of the walls 30,48 of the building 34. As shown in FIG. 8, preferably at least a portion 44 of the flattened attachment portion 38 of each roof panel 10 rests, either directly or indirectly on the top surface 46 of the side walls 48 of the building 34. Each roof panel 10 is preferably coupled to each associated sidewall 48 in at least one location. As shown in FIG. 9, preferably at least a portion of the lower surface 56 of the stem portion 28 of each end roof panel 24 rests, either directly or indirectly, on the top surface 58 of the end walls 30 of the building 34.

Each roof panel 10 is preferably coupled to each associated side wall 48 in at least one location. The roof panels 10 may be coupled to the side walls 48 using any means known in the art.

In one illustrated embodiment the roof panels 10 may be coupled to concrete side walls 48 as shown in FIG. 8 and described below. Preferably, at least one aperture 60 is formed through each roof panel attachment portion 38 and a corresponding bore 62 is formed into the top surface 46 of the side wall 48. The bore 62 and aperture 60 are preferably aligned when the roof panel 10 is in place on the side wall 48. A fixation member 52 is preferably secured in each of the bores 62. The fixation member 52, such as a threaded rod, may be secured in the bore 62 by use of an insert 64. In use, the insert 64 is placed in the bore 62. In the illustrated embodiment the insert 64 comprises a generally cylindrical member having a first end 66 and a second end 68. The insert 64 may take any form known in the art, including, but not limited to a coil insert. The insert 64 may desirable have a threaded interior surface. The fixation member 52 is secured in the bore 62 by threading the fixation member 52 into the first end of the insert 64.

It is contemplated that the insert 64 may be cast in the side wall 48. It is further contemplated that the insert 64 may be placed into a bore 62 formed in the top surface 46 of the side wall 48 during or after the side wall 48 is cast. The insert 64 may be secured within the bore 62 by an adhesive substance such as, but not limited to, non-shrink grout.

The roof panel 10 may then be placed in position such that the fixation member 52 extends through the aperture 60 in the roof panel 10. The aperture 60 may be filled with an adhesive substance, including, but not limited to non-shrinking grout. If desired, a sleeve (not shown) may be placed in the roof panel during production to form the aperture 60. If desired, the fixation member 52 may then be secured from the top of the roof panel 10. The fixation member 52 may be secured using any means known in the art. In the illustrated embodiment the fixation member 52 is secured by tightening a locking member 54, such as a nut onto end of the fixation member 52. If desired, the free end of the fixation member 52 may be cut off and the cavity 50 may be filled with an adhesive substance such as, but not limited to, non-shrink grout.

If desired, the insert 64 may include a second fixation member 52 coupled to the second end 68 thereof, the second fixation member 52 extending further into the side wall 48 as shown in FIG. 8. If desired, the insert 64 may include a plate 72 coupled to the first end 66 of the insert 64. The plate 72 preferably includes an aperture 74 therethrough, the aperture 74 being aligned with the generally circular opening 76 at the first end 66 of the insert 64. The plate 72 may be coupled to the insert 64 using any means known in the art including, but not limited to welding.

If desired, at least one bearing pad 78 or shim may be placed between the roof panel 10 and the top surface 46 of the side wall 48.

Each roof panel 10 is preferably coupled to an associated end wall 30 of the building 34 in at least one location. The roof panels 10 may be coupled to the end walls 30 using any means known in the art.

Figure 9A:
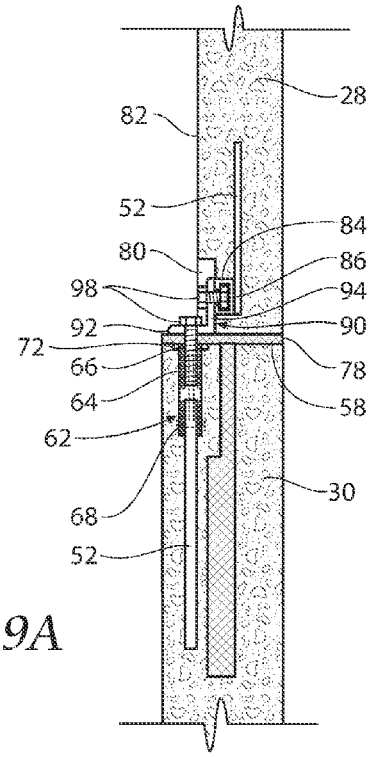
FIGS. 9A and 9B are cross sectional and perspective views, respectively of an embodiment of a joint between a roof panel of FIG. 1 and an end wall of a building.
Figure 9B:
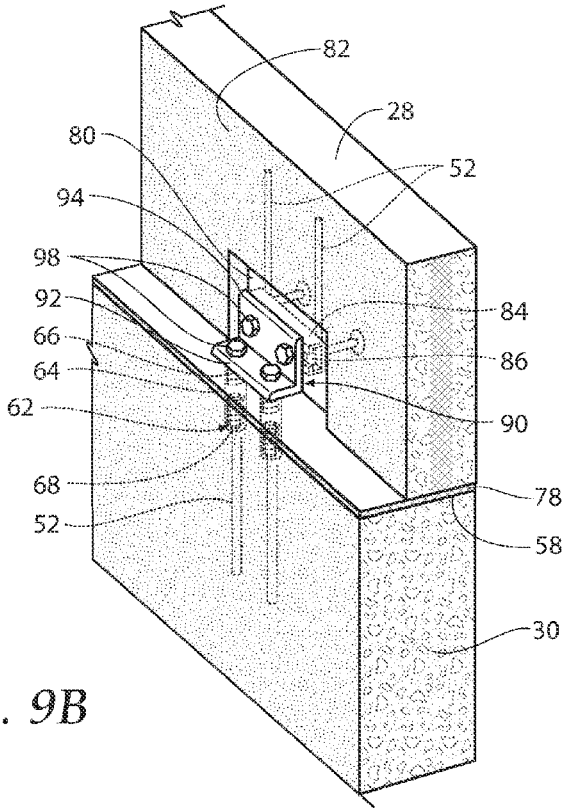

In an illustrated embodiment, the end roof panels 24 may be coupled to concrete end walls 30 as shown in FIGS. 9A and 9B. In the illustrated embodiment preferably at least one cavity 80 is formed on the inner surface 82 of the stem portion 28 of each end panel 24. The cavity 80 is preferably located near the bottom surface 56 of the stem portion 28. A unistrut 84 is located in the cavity 80. The unistrut 84 is preferably cast during production of the roof panel. At least one spring channel nut 86 is located in the unistrut channel 88. Preferably two spring channel nuts 86 are inserted in the unistrut channel 88.

At least one insert 64 is preferably located in the end wall 30. The insert 64 is preferably arranged such that the first end 66 of the insert 64 is at the top surface 58 of the end wall 30. It is contemplated that the insert 64 may be cast in the end wall 30. It is further contemplated that a bore 62 may be formed in the top surface 58 of the end wall 30 and the insert 64 may be secured within the bore 62 using an adhesive substance, such as but not limited to non-shrink grout. If desired, a fixation member 52, such as a coil rod, may be coupled to the second end 68 of the insert 54, the fixation member 52 extending into the end wall 30 as shown in FIG. 9. In the illustrated embodiment two spaced apart inserts 64 are utilized at each connection point.

An angled bracket 90 is preferably provided. The bracket 90 preferably includes a first plate member 92 coupled to a second plate member 94. The first plate member 92 may be integrally formed to the second plate member 94 or plates 92,94 may be coupled using any means known in the art including, but not limited to welding. Each of the first 92 and second 94 plates preferably includes a pair of apertures 96 therethrough. The bracket 90 is aligned such that the apertures 96 on the first plate member 92 are aligned with the first ends 66 of the inserts 64. A fastening member 98, such as but not limited to a screw, is inserted through each aperture 96 and threaded into its corresponding insert 64. The bracket 90 is also aligned such that the apertures 96 on the second plate 94 are aligned with the holes 100 in the channel spring nuts 86 located in the unistrut channel 88. A fastening member 98 is inserted through each aperture 96 and threaded into its corresponding channel spring nut 86.

It is further contemplated that the roof panels 10 may be coupled to a steel structure. The roof panels 10 may be coupled to a steel structure using any means known in the art including, but not limited to expansion bolts or welded connections.

Figure 12:
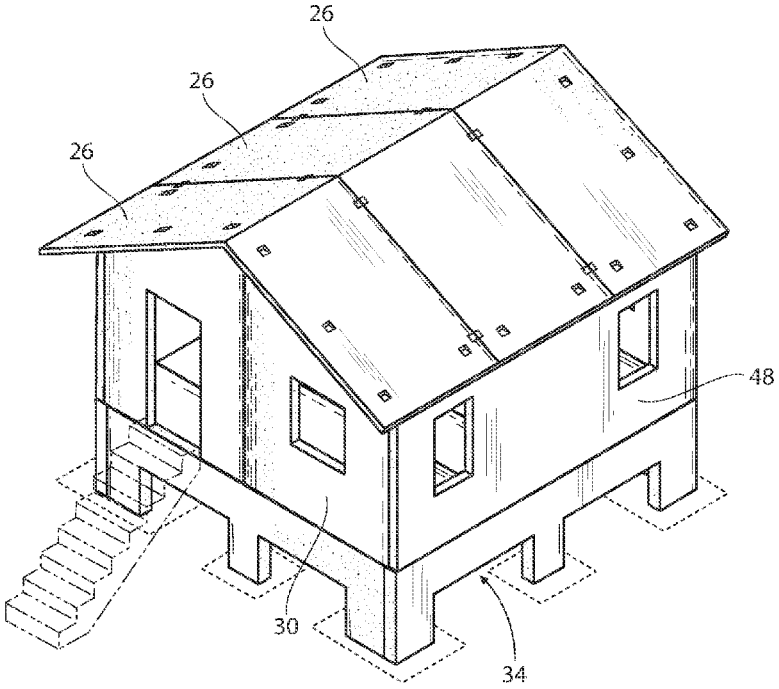
FIG. 12 is a perspective view showing the roof panels of FIG. 4 on a building.

It is contemplated that any number of roof panels 10 may be combined to form a roof for a building 34. Preferably at least two end panels 24 are utilized. It is contemplated that a roof may comprise only a first end panel 24 with its stem portion 28 at the front side of the building 34 and a second end panel 24 with its stem portion 28 at the rear side of the building 34. It is further contemplated that any number of inner roof panels 26 may be utilized between the two end panels 24. It is further contemplated that only interior panels may be utilized to form a roof, as shown in FIG. 12.

As shown in FIG. 7, preferably multiple roof panels 10 are used on a single building 34. Adjacent roof panels 10 can be coupled to each other using any means or methods known in the art.

Figure 10:
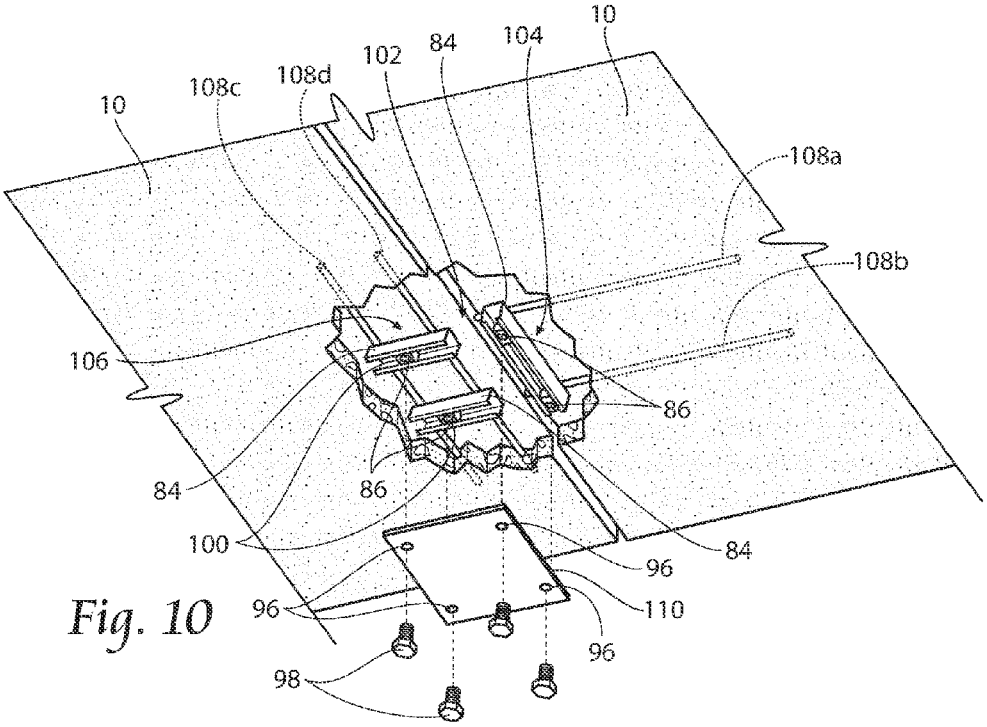
FIG. 10 is a close-up view of an embodiment of a joint between adjacent roof panels.

In one illustrated embodiment each roof panel 10 may be secured to an adjacent roof panel 10 using a connection device 102 as shown in FIG. 10. The connection device 102 preferably includes a first portion 104 located in the first panel 10 and a second portion 106 located in the second panel 10. The portions of the connection device 102 are preferably cast in their respective panels 10.

As shown in FIG. 10, the first portion 104 preferably comprises a first rod 108A and a second rod 108B coupled to a first unistrut channel 84. A pair of channel spring nuts 86 a preferably disposed within the first unistrut channel 84. The second portion 106 preferably comprises a third rod 108C and a fourth rod 108D coupled to a second unistrut channel 84 and a third unistrut channel 84. A channel spring nut 86 is preferably disposed in each of the second and third unistrut channels 84. The rods 108 may be coupled to the unistrut channels 84 using any means known in the art including, but not limited to welding.

In use, a plate 110 is placed over the plurality of unistrut channels 84. The plate 110 preferably includes a plurality of apertures 96 therethrough. The apertures 96 in the plate 110 are aligned with the apertures 96 in the channel spring nuts 86. It should be understood that the channel spring nuts 86 are slidable within the unistrut channels 84 to align each nut 86 with an aperture 96 in the plate 110. A fastening member 98, such as a screw, is then inserted into each of the apertures 96 in the plate. The fastening members 98 may then be tightened.

Each roof panel 10 is coupled to each adjacent roof panel 10 in at least one location on each roof member 12, in other words in two locations per roof panel 10. In the illustrated embodiment each roof panel 10 is coupled to each adjacent roof panel 10 in two locations per roof member 12, or four locations per roof panel 10.

Figure 11:
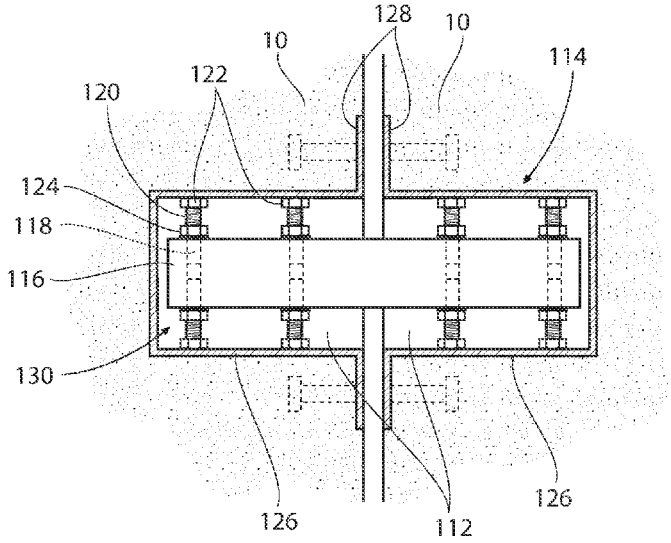
FIG. 11 is a close-up view of an alternative embodiment of a joint between adjacent roof panels.

FIG. 11 shows an alternative illustrated method and apparatus for coupling a first roof panel 10 to an adjacent second roof panel 10. Preferably, at least one rectangular cavity 112 is formed in the outer surface 14 of each adjacent roof panel 10 at the side surface 22. A fastening device 114 is then placed in the cavity 112 and adjusted to couple the adjacent panels 10. In the illustrated embodiment the fastening device 114 takes the form of a generally rectangular fastening member 116 with a plurality of holes 118 formed therein. A securing member 120 is threaded into each hole 118. The securing member 120 preferably has a head 122, and may take the form of a bolt and preferably includes a locking member 124, such as a nut threaded thereon. The illustrated embodiment further includes a fastening plate 126 which preferably mirrors the shape of the cavity and includes a pair of flanges 128.

The panels 10 are first placed in position. At least one cavity 112 is them formed, or the rectangular cavities 112 may be cast in the panels 10. It should be understood that the cavities 112 are only formed on the sides of the roof panels 10 that are adjacent the side surface 22 of another roof panel 10. As seen in FIG. 11, the first cavity 112 formed in the first panel 10 and the second cavity 112 formed in the second panel 10 form a larger fixation cavity 130. A fastening plate 126 may be placed in each cavity 112. The fastening device 114 is placed in the fixation cavity 130. The securing members 120 and locking members 124 are adjusted to firmly retain the fastening device 114 and fastening plate 126 within the cavities 112 and to secure the first panel 10 to the second panel 10. This may be achieved by rotating each securing member 120 until its head 122 engages the wall of the cavity 112. The locking member 124 is then rotated to lock the securing member 120 in place.

In an additional alternative embodiment (not shown) the roof panels 10 may be coupled using a fastening device comprising a fastening plate which may be placed at the intersection of a pair of adjacent roof panels 10 such that the first end of the fastening plate is on a first roof panel 10 and the second end of the fastening plate is on a second adjacent roof panel 10. The fastening plate may include a plurality of holes formed therethrough, preferably the fastening plate includes two holes in each end of the fastening plate. A fixation member such as a screw may be inserted through each of the holes in the fastening plate and into an associated roof panel member 12. Preferably, two fixation plates are used on each side of each roof member 12. However, any number of fixation plates may be utilized. It should be understood that the fastening plates are only attached near sides of the roof panels 10 that are adjacent the side surface 22 of another roof panel 10.

It is further contemplated that the roof panels 10 may be coupled using a welded connection (not shown).

It is contemplated that is may be desirable to form the outer surface 14 of the roof panels 10 may be formed with a texture or pattern. The texture may take any desired configuration including, but not limited to a shingled texture.

It is further contemplated that if the end walls 30 of the building 34 are formed with a peaked configuration that only inner roof panels 26 could be utilized on the roof of the building 34, as shown in FIG. 12.

It is further contemplated that, if desired, the roof panels may have insulation embedded within any portion of the roof panel.

It is further contemplated that, if desired, the roof panels 10 may have integrally formed gutters 132 formed in the outer surface 14 of the panels 10 near the end 20 surfaces thereof.

Although the illustrated embodiment depicts the use of the roof panels 10 with a modular concrete panel building, it is contemplated that the concrete roof panels 10 may be utilized on various types of buildings, including, but not limited to a steel framed building, a poured concrete building, or a building constructed from concrete block.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A roof panel for a modular concrete building, the roof panel comprising:

a first member having an outer surface, an inner surface, a medial surface, an end surface, a first side surface, and a second side surface, the first member having a first attachment portion formed on the inner surface near the end surface;

a second member having an outer surface, an inner surface, a medial surface, an end surface, a first side surface, and a second side surface, the second member having a second attachment portion formed on the inner surface near the end surface;

a first rib member formed on the inner surface of the first member and a second rib member formed on the inner surface of the second member, each of the rib members extending along the inner surface from the medial surface to the attachment portion;

wherein the medial surface of the first member is integrally formed to the medial surface of the second member and the first member and second member are not coplanar;

wherein the first rib member is integrally formed to the second rib member;

a first stiffening member having a first stiffening member first portion having a first end and a second end and a first stiffening member second portion integrally formed at the second end of the first stiffening member first portion at a first angle which is greater than zero degrees and less than 180 degrees, wherein the first stiffening member first portion is partially disposed within each of the first rib member and second rib member such that the first end of the first stiffening member first portion is disposed within the first rib member and the second end of the first stiffening member first portion is disposed within the second rib member, and wherein the first angle and the first stiffening member second portion are disposed within the second rib member; and a second stiffening member having a second stiffening member first portion having a first end and a second end and a second stiffening member second portion integrally formed at the second end of the second stiffening member first portion, wherein the second stiffening member first portion is partially disposed within each of the first rib member and second rib member such that the first end of the second stiffening member first portion is disposed within the second rib member and the second end of the second stiffening member first portion is disposed within the first rib member, and wherein the second stiffening member second portion is disposed within the first rib member.

2. A device according to claim 1 wherein the first and second stiffening members comprise rebar.

3. A device according to claim 1 further comprising at least one additional stiffening member within each of the first member and the second member.

4. A device according to claim 3 wherein the at least one additional stiffening member comprises rebar.

5. A device according to claim 3 wherein the at least one additional stiffening member comprises wire mesh.

6. A device according to claim 1 further comprising an obtuse angle between inner surface of the first member and the inner surface of the second member.

7. A device according to claim 1 further comprising a stem portion formed on the inner surface of both the first member and the second member, the stem portion having a generally triangular configuration, wherein the triangular stem portion has a generally flat lower surface that extends from the inner surface of the first member to the inner surface of the second member.

8. A device according to claim 7 further comprising at least one stiffening member within the stem portion.

9. A device according to claim 8 wherein said stiffening member within the stem portion comprises rebar.

10. A device according to claim 1 further comprising:

a third rib member formed on the inner surface of the first member and a forth rib member formed on the inner surface of the second member, each of the rib members extending along the inner surface from the medial surface to the attachment portion;

a third stiffening member having a third stiffening member first portion having a first end and a second end and a third stiffening member second portion integrally formed at the second end of the third stiffening member first portion, wherein the third stiffening member first portion is partially disposed within each of the third rib member and fourth rib member such that the first end of the third stiffening member first portion is disposed within the third rib member and the second end of the third stiffening member first portion is disposed within the fourth rib member, and wherein the third stiffening member second portion is disposed within the fourth rib member; and a fourth stiffening member having a fourth stiffening member first portion having a first end and a second end and a fourth stiffening member second portion integrally formed at the second end of the fourth stiffening member first portion, wherein the fourth stiffening member first portion is partially disposed within each of the third rib member and fourth rib member such that the first end of the fourth stiffening member first portion is disposed within the fourth rib member and the second end of the fourth stiffening member first portion is disposed within the third rib member, and wherein the second stiffening member second portion is disposed within the third rib member.

11. A roof panel for a modular concrete building, the roof panel comprising:

a first member having an outer surface, an inner surface, a medial surface, an end surface, a first side surface, and a second side surface, the first member having a first attachment portion formed on the inner surface near the end surface and at least one aperture formed in the attachment portion for receiving at least one fixation member extending from an adjacent component of the modular concrete building;

a second member having an outer surface, an inner surface, a medial surface, an end surface, a first side surface, and a second side surface, the second member having a second attachment portion formed on the inner surface near the end surface and at least one aperture formed in the attachment portion for receiving at least one fixation member extending from an adjacent component of the modular concrete building;

a first rib member formed on the inner surface of the first member and a second rib member formed on the inner surface of the second member, each of the rib members extending along the inner surface from the medial surface to the attachment portion;

wherein the medial surface of the first member is integrally formed to the medial surface of the second member and the first member and second member are not coplanar;

wherein the first rib member is integrally formed to the second rib member;

a first stiffening member having a first stiffening member first portion having a first end and a second end and a first stiffening member second portion integrally formed at the second end of the first stiffening member first portion at a first angle which is greater than zero degrees and less than 180 degrees, wherein the first stiffening member first portion is partially disposed within each of the first rib member and second rib member such that the first end of the first stiffening member first portion is disposed within the first rib member and the second end of the first stiffening member first portion is disposed within the second rib member, and wherein the first angle and the first stiffening member second portion are disposed within the second rib member; and a second stiffening member having a second stiffening member first portion having a first end and a second end and a second stiffening member second portion integrally formed at the second end of the second stiffening member first portion, wherein the second stiffening member first portion is partially disposed within each of the first rib member and second rib member such that the first end of the second stiffening member first portion is disposed within the second rib member and the second end of the second stiffening member first portion is disposed within the first rib member, and wherein the second stiffening member second portion is disposed within the first rib member.

* * * * *

UNITED STATES PATENT AND TRADEMARK OFFICE

CERTIFICATE OF CORRECTION

PATENT NO. : 8,763,317 B2
APPLICATION NO. : 12/319027
DATED : July 1, 2014
INVENTOR(S) : Clinton Krell It is certified that error appears in the above-identified patent and that said Letters Patent is hereby corrected as shown below:

In The Claims

Column 8, line 3 of claim 10, after “member and a” delete “forth” and substitute -- fourth --

Signed and Sealed this
Seventeenth Day of March, 2015

Michelle K. Lee

Michelle K. Lee
*Director of the United States Patent and Trademark Office*